US008123906B2

(12) United States Patent
Soane et al.

(10) Patent No.: US 8,123,906 B2
(45) Date of Patent: Feb. 28, 2012

(54) FUNCTIONALIZATION OF PAPER COMPONENTS

(75) Inventors: David S. Soane, Chestnut Hill, MA (US); Michael C. Berg, Somerville, MA (US); William A. Mowers, Lynn, MA (US)

(73) Assignee: NanoPaper, LLC, Cambridge, MA (US)

( * ) Notice: Subject to any disclaimer, the term of this patent is extended or adjusted under 35 U.S.C. 154(b) by 500 days.

(21) Appl. No.: 12/184,308

(22) Filed: Aug. 1, 2008 (Under 37 CFR 1.47)

(65) Prior Publication Data

US 2009/0165975 A1 Jul. 2, 2009

Related U.S. Application Data

(63) Continuation of application No. PCT/US2007/003159, filed on Feb. 5, 2007.

(60) Provisional application No. 60/765,119, filed on Feb. 3, 2006, provisional application No. 60/864,783, filed on Nov. 7, 2006.

(51) Int. Cl.
*D21H 21/18* (2006.01)
*D21H 17/24* (2006.01)

(52) U.S. Cl. ..... 162/175; 162/164.4; 162/168.2; 162/168.3; 162/178; 162/182; 162/183

(58) Field of Classification Search ..... 162/164.1, 162/164.3, 164.6, 168.1, 168.2, 169, 183, 162/175, 178, 181.1–181.9, 182
See application file for complete search history.

(56) References Cited

U.S. PATENT DOCUMENTS

| | | | | | |
|---|---|---|---|---|---|
| 2,601,597 | A | * | 6/1952 | Daniel, Jr. et al. | 162/164.3 |
| 3,049,469 | A | * | 8/1962 | Davison | 162/164.3 |
| 3,545,909 | A | | 12/1970 | Gagliardi | |
| 3,567,680 | A | | 3/1971 | Iannicelli | |
| 3,902,958 | A | * | 9/1975 | Breen et al. | 162/164.5 |
| 4,084,983 | A | | 4/1978 | Bernhard et al. | |
| 4,102,738 | A | | 7/1978 | Dzurik | |
| 4,142,724 | A | | 3/1979 | Reick | |
| 4,151,154 | A | | 4/1979 | Berger | |
| 4,199,142 | A | | 4/1980 | Reick | |
| 4,246,066 | A | * | 1/1981 | Amano et al. | 162/141 |
| 4,251,282 | A | | 2/1981 | Vahlensieck et al. | |
| 4,260,540 | A | | 4/1981 | Rolf | |
| 4,309,480 | A | | 1/1982 | Armanini | |
| 4,377,518 | A | | 3/1983 | Vor Der Brueck | |
| 4,398,915 | A | | 8/1983 | Panto et al. | |
| 4,402,703 | A | | 9/1983 | Panto et al. | |
| 4,543,128 | A | | 9/1985 | Troesch | |
| 4,566,908 | A | | 1/1986 | Nakatani | |
| 4,655,843 | A | | 4/1987 | Marraccini et al. | |
| 4,686,287 | A | | 8/1987 | Hunger | |
| 4,755,229 | A | | 7/1988 | Armanini | |
| 4,925,530 | A | | 5/1990 | Sinclair et al. | |
| 4,968,351 | A | | 11/1990 | Ahmed et al. | |
| 5,154,864 | A | | 10/1992 | Nishiyama et al. | |
| 5,200,036 | A | * | 4/1993 | Noda | 162/164.3 |
| 5,338,406 | A | * | 8/1994 | Smith | 162/168.2 |
| 5,344,489 | A | | 9/1994 | Matijevic et al. | |
| 5,378,574 | A | | 1/1995 | Winnik et al. | |
| 5,466,337 | A | * | 11/1995 | Darlington et al. | 162/164.3 |
| 5,493,011 | A | | 2/1996 | Jung | |
| 5,532,059 | A | | 7/1996 | Lee | |
| 5,656,257 | A | | 8/1997 | Fealy et al. | |
| 5,827,610 | A | | 10/1998 | Ramachandran | |
| 5,958,180 | A | | 9/1999 | Hubbe et al. | |
| 5,998,026 | A | | 12/1999 | Ramachandran | |
| 6,096,469 | A | | 8/2000 | Anderson et al. | |
| 6,129,786 | A | | 10/2000 | Camara et al. | |
| 6,139,688 | A | | 10/2000 | Ramachandran | |
| 6,228,217 | B1 | * | 5/2001 | Dickerson et al. | 162/158 |
| 6,358,569 | B1 | | 3/2002 | Badyal et al. | |
| 6,368,456 | B1 | | 4/2002 | Cimecioglu et al. | |
| 6,497,732 | B1 | | 12/2002 | Soane et al. | |
| 6,497,733 | B1 | | 12/2002 | Ware, Jr. et al. | |
| 6,599,631 | B2 | | 7/2003 | Kambe et al. | |
| 6,603,054 | B2 | | 8/2003 | Chen et al. | |
| 6,607,994 | B2 | | 8/2003 | Soane et al. | |
| 6,617,267 | B2 | | 9/2003 | Soane et al. | |
| 6,635,702 | B1 | | 10/2003 | Schmucker et al. | |
| 6,638,984 | B2 | | 10/2003 | Soane et al. | |

(Continued)

FOREIGN PATENT DOCUMENTS

EP 0213931 3/1987

(Continued)

OTHER PUBLICATIONS

International Preliminary Examination Report, from PCT/US06/031018, mailed Feb. 12, 2008. International Search Report, from PCT/US06/031017, mailed Feb. 2, 2007.
International Search Report, from PCT/US07/003159, mailed Sep. 24, 2007.
International Search Report, from PCT/US06/031018, mailed Oct. 1, 2007.
International Search Report, from PCT/US07/022803, mailed May 19, 2008.
Lau, K. et al., "Superhydrophobic carbon nanotube forests," Nano. Lett. 3(12):1701-05 (2003).
Li, H. et al., "Adsorption and Complexation of Chitosan Wet-End Additives in Papermaking Systems," 91 J. Appl. Polymer Sci. 2642-48 (2004).
Li, H. et al., "Effect of Molecular Weight and Degree of Substitution of Quaternary Chitosan on its Adsorption and Flocculation Properties for Potential Retention-Aids in Alkaline Papermaking," 242 Colloids and Surfaces A: Physicochem. Eng. Aspects 1-8 (2004).
McKay et al., "Adsorption of Dyes on Chitin: Equilibrium Studies," J. Applied Polymer sci. 27:3043-4057 (1982).
Morra, M. et al., "Contact angle hysteresis in oxygen plasma treated poly (tetrafluoroethylene)" Langnuir 5(3):872-76 (1989).

(Continued)

*Primary Examiner* — Eric Hug
*Assistant Examiner* — Peter Chin
(74) *Attorney, Agent, or Firm* — Elmore Patent Law Group, P.C.; Mahreen Chaudhry Hoda; Carolyn S. Elmore

(57) ABSTRACT

Compositions and methods of producing paper-based materials are disclosed. In general, the techniques utilize an amine-containing polymer, such as chitosan, to functionalize one or more components of a mixture used to form materials such as paper-based materials. Such components can include the fibers of a pulp and/or filler particles. In one instance, either the pulp or the filler particles are functionalized, but not both. Such functionalization can improve the qualifies of a paper-based material relative to when such functionalization is not utilized. Techniques and compositions are also described to further improve the qualities of a paper material by utilizing a complementary polymer which can couple with the amine-containing polymer.

12 Claims, No Drawings

U.S. PATENT DOCUMENTS

| | | | | |
|---|---|---|---|---|
| 6,649,222 | B1 | 11/2003 | D'Agostino et al. | |
| 6,679,924 | B2 | 1/2004 | Ware et al. | |
| 6,696,051 | B2 | 2/2004 | Barbuzzi et al. | |
| 6,743,936 | B1 | 6/2004 | Wellingkoff et al. | |
| 6,780,497 | B1 | 8/2004 | Walter | |
| 6,796,649 | B2 | 9/2004 | Chu et al. | |
| 6,812,276 | B2 | 11/2004 | Yeager et al. | |
| 6,824,650 | B2 | 11/2004 | Lindsay et al. | |
| 6,852,390 | B2 | 2/2005 | Extrand | |
| 6,881,490 | B2 | 4/2005 | Kambe et al. | |
| 6,884,479 | B2 | 4/2005 | Chu et al. | |
| 6,913,639 | B2 | 7/2005 | Wang et al. | |
| 6,923,216 | B2 | 8/2005 | Extrand et al. | |
| 6,936,136 | B2 * | 8/2005 | Shannon et al. | 162/9 |
| 6,939,443 | B2 * | 9/2005 | Ryan et al. | 162/164.1 |
| 6,955,844 | B2 | 10/2005 | Tagge et al. | |
| 7,074,845 | B2 | 7/2006 | Laleg | |
| 7,282,263 | B2 | 10/2007 | Rasmusen et al. | |
| 7,625,962 | B2 * | 12/2009 | Laleg | 524/47 |
| 2002/0068139 | A1 | 6/2002 | Polak et al. | |
| 2002/0149656 | A1 | 10/2002 | Nohr et al. | |
| 2003/0213410 | A1 | 11/2003 | Adams et al. | |
| 2004/0013964 | A1 | 1/2004 | Ogata | |
| 2004/0110883 | A1 | 6/2004 | Pakan et al. | |
| 2005/0038498 | A1 | 2/2005 | Dubrow et al. | |
| 2005/0084456 | A1 | 4/2005 | Tang et al. | |
| 2005/0170192 | A1 | 8/2005 | Kambe et al. | |
| 2005/0181195 | A1 | 8/2005 | Dubrow | |
| 2007/0107635 | A1 | 5/2007 | Soane et al. | |
| 2007/0108418 | A1 | 5/2007 | Soane et al. | |
| 2007/0149650 | A1 | 6/2007 | Masuda | |
| 2008/0271865 | A1 | 11/2008 | Soane et al. | |
| 2009/0165975 | A1 | 7/2009 | Soane et al. | |

FOREIGN PATENT DOCUMENTS

| | | |
|---|---|---|
| EP | 0239079 | 9/1987 |
| EP | 0246090 | 11/1987 |
| EP | 286850 | 10/1988 |
| EP | 0325484 | 1/1989 |
| EP | 0812956 | 12/1997 |
| FR | 2831176 | 4/2003 |
| FR | 2831178 | 4/2003 |
| FR | 2872412 | 1/2006 |
| FR | 2879097 | 6/2006 |
| GB | 948163 | 1/1964 |
| GB | 2278114 | 11/1994 |
| JP | 63316717 | 12/1988 |
| WO | WO 01/78663 | 10/2001 |
| WO | WO 03/035771 | 5/2003 |
| WO | WO 2004/041942 | 5/2004 |
| WO | WO 2004/063285 | 7/2004 |
| WO | WO 2004/065473 | 8/2004 |
| WO | WO 2005/061627 | 7/2005 |
| WO | WO 2007/021730 | 2/2007 |
| WO | WO 2007/021731 | 2/2007 |
| WO | WO 2007/092450 | 8/2007 |
| WO | WO 2008/057312 | 5/2008 |

OTHER PUBLICATIONS

Nordell, P., "Wet-Strength Development of Paper," Master of Science Programme, Mechanical Engineering, Lulea Univ. of Technology 2006:023 CIV.

U.S. Appl. No. 60/785,432, publically available on Feb. 22, 2007 along with publication of WO 2007/021730.

U.S. Appl. No. 60/706,852, publically available on Feb. 22, 2007 along with publication of WO 2007/021730.

U.S. Appl. No. 60/706,853, publically available on Feb. 22, 2007 along with publication of WO 2007/021730.

U.S. Appl. No. 60/765,117, publically available on Feb. 22, 2007 along with publication of WO 2007/021730.

U.S. Appl. No. 60/708,415, publically available on Feb. 22, 2007 along with publication of WO 2007/021730.

U.S. Appl. No. 60/712,059, publically available on Feb. 22, 2007 along with publication of WO 2007/021731.

U.S. Appl. No. 60/725,827, publically available on Feb. 22, 2007 along with publication of WO 2007/021731.

Wu et al., "Adsorption of Dyes on Nanosize Modified Silica Particles," J. Colloid and Interface Sci. 195:222-28 (1997).

Zhai, L. et al., "Patterned superhydrophobic surfaces: Toward a synthetic mimic of the namib desert beetle," Nano. Lett. 6(6):1213-17 (2006).

Zhai, L. et al., "Stable superhydrophobic coatings from polyelectrolyte multilayers," Nano Lett. 7:1349 (2004).

* cited by examiner

FUNCTIONALIZATION OF PAPER COMPONENTS

CROSS-REFERENCE TO RELATED APPLICATIONS

This application is a continuation of PCT Application No. PCT/US07/03159, filed Feb. 5, 2007, which application claims the benefit of a U.S. Provisional Patent Application filed on Feb. 3, 2006 and bearing Ser. No. 60/765,119; and another U.S. Provisional Patent Application filed on Nov. 7, 2006 and bearing Ser. No. 60/864,783. All applications are hereby incorporated by reference herein in their entirety.

FIELD OF THE INVENTION

The technical field of the invention relates to compositions and methods for enhancing the properties of materials such as paper-related products.

BACKGROUND OF THE INVENTION

Paper manufacturing is an important industrial process, resulting in the production of a vast variety of products. Paper products oftentimes include the use of filler materials, which allow products to be produced more cheaply. The use of fillers, however, can decrease the quality of the product in terms of strength, appearance, and other features. Though additives have been derived for further improving the quality of manufactured paper, a need persists for processes and compositions that further improve the quality of paper. Indeed, the development of additives which result in improved efficiency and lower cost production is desirable.

SUMMARY OF THE INVENTION

In one aspect, the compositions and methods disclosed herein relate to methods for enhancing the mechanical properties of paper. In particular, these compositions and methods can relate to improving the economics of papermaking, or can enable paper fibers to be used in other applications where presently their use has been limited by their mechanical properties.

In another aspect, the techniques disclosed herein can enhance other advantageous properties of paper, such as the hydrophobicity of paper.

In other embodiments, the pulp and/or filler to be used in making a paper sheet can be functionalized with an amine-containing polymer. In some embodiments, a complimentary polymer can be added either sequentially or in an emulsion form. When performed sequentially, the complimentary polymer can be added either before or after the formation of a paper sheet.

Accordingly, some exemplary embodiments are drawn toward a mixture, which can be used for producing a paper based material. The mixture can include an aqueous medium, a pulp comprising fibers, filler particles, and an amine-containing polymer. The amine-containing polymer can enhance properties of either the mixture or a paper-based material to be produced from the mixture. The fibers of the pulp can be substantially free of synthetic polymer-based fibers, and/or can have a net negative charge. The filler particles can have an inorganic surface, and can include one or more of calcium carbonate, kaolin, and titanium dioxide. In one related embodiment, the amine-containing polymer can be adapted to functionalize a surface of the filler particles. Optionally in this embodiment, the fibers of the pulp are not substantially functionalized by the amine-containing polymer. In another embodiment, the amine-containing polymer can be substantially coupled to, or functionalize, only one of the pulp and the filler particles.

Amine-containing polymers used in some embodiments can include at least one of a homopolymer and a copolymer. The amine-containing polymer can also include at least a polycationic segment such as at least one segment of chitosan, polyalkyleneimine, polyvinyl amine, and polyallyl amine. In a particular embodiment, the amine-containing polymer includes one or more segments of any one of chitosan and branched polyethyleneimine. One or more crosslinking agents (e.g., a silane coupling agent) can be used to couple the amine-containing polymer to a paper component (e.g., filler particles, fibers of pulp, or both). A crosslinking agent can include two or more functionalities for reacting with the amine-containing polymer and/or a paper making component (e.g., filler particles, pulp fibers, or both).

Consistent with some embodiments, a complementary polymer can be included for enhancing the properties of a mixture or a paper-based material. Such embodiments can be utilized when both a pulp and filler particles are functionalized by an amine-containing polymer, though only one of the pulp and fillers can be functionalized as well. For example, one exemplary embodiment can be drawn to a mixture including an aqueous medium; a pulp with fibers; an amine-containing polymer for functionalizing a surface of the fibers; and a complementary polymer capable of coupling with the amine-containing polymer.

In general, the complementary polymer can be capable of coupling with the amine-containing polymer, either through reaction or some nonreactive interaction (e.g., electrostatic attraction). This can couple a portion of the pulp with a portion of the filler when the amine-containing polymer functionalizes both components. Complementary polymers can be polyanionic, and can be a homopolymer, copolymer, or any combination thereof. The complementary polymer can also include one or more epoxide, anhydride (e.g., maleic anhydride), carboxylic acid, and isocynate groups. Non-limiting examples of complementary polymers include polymers that have at least one polymer segment of pectin, xanthan gum, carboxymethyl cellulose, polyacrylic acid, and polymethacrylic acid. Other types of complementary polymers can have an elastomeric component or a component that increases water resistance of a paper-based material. In a related embodiment, the amine-containing polymer can emulsify the complementary polymer (e.g., a polymer that is substantially insoluble in water).

Other exemplary embodiments are drawn to methods of producing a paper-based material. In one embodiment, fibers of a pulp are functionalized using an amine-containing polymer. Filler particles can be combined with the functionalized fibers of the pulp to produce at least a portion of a paper-forming mixture. The mixture can be used to produce a paper-based material. In such an embodiment, the amine-containing polymer optionally does not functionalize the filler particles. In an alternate embodiment, the filler particles are functionalized with the amine-containing polymer. The pulp can be combined with the functionalized filler particles to form the portion of the paper-forming mixture. In the alternate embodiment, the amine-containing polymer optionally does not functionalize the pulp (e.g., the fibers of the pulp). It is also understood that in some of these embodiments, both the filler and the pulp can be functionalized by the amine-containing polymer.

These method embodiments can utilize any of the filler particles, pulps, and amine-containing polymers described herein. As well, the methods can include any of the mixtures described herein as well. For instance, the functionalization of fibers of pulp, or filler particles, can be achieved by combining the component with an amine-containing polymer that can include chitosan segments and/or branched polyethyleneimine segments. In one particular instance, the pulp or filler particles can be combined with chitosan to form a functionalizing mixture. The pH of the functionalizing mixture can be raised to at least about 6 to cause the chitosan to associate with the pulp and/or filler particles.

Embodiments drawn to methods of producing paper based materials can also utilize a complementary polymer, the use of which can be consistent with other embodiments disclosed herein. The complementary polymer can be capable of coupling with the amine-containing polymer, through any combination of chemical reaction and nonreactive interaction mechanisms (e.g., electrostatic interactions). The complementary polymer can provide one or more enhanced properties to the produced paper material relative to materials that do not utilize a complementary polymer. Non-limiting examples of enhanced properties include mechanical properties such as strength, stiffness, wear resistance, water resistance (e.g., though increased water contact angle), and elasticity. In some instances, a sheet can be formed using the paper-forming mixture, where the complementary polymer can be added either before or after the sheet is formed. Furthermore, when the complementary polymer is added to a sheet, the addition can occur either before or after the sheet is dried. In other instances, functionalizing either the fibers of a pulp or the filler particles can include emulsifying the complementary polymer with the amine-containing polymer (e.g., a hydrophobic polymer), and adding the emulsion to the component being functionalized.

Other embodiments are drawn to paper-based materials produced using any of the compositions or methods disclosed herein.

DETAILED DESCRIPTION

As utilized in the present application, the term "functionalization" and "functionalize" refer to a change in one or more aspects of the physicochemical nature of an entity. For example, with respect to a particle, functionalization of a particle surface refers to a change in one or more aspects of the particle surface, which result in some physicochemical change in how the particle surface interacts with other entities. Consistent with some embodiments described herein, functionalization of an entity can result in a change in some macroscopic property (e.g., tensile strength) when the functionalized entity is used to produce a product due to the associations of the functionalized entity with other components, or even with other functionalized entities. Functionalization can also alter the types of chemical reactions that an entity can be subjected to relative to when the entity is not functionalized.

The term "polymer" refers to a molecule comprising a plurality of repeat units or monomers. A polymer can comprise one or more distinct repeat units. For example, a "copolymer" refers to a polymer having two or more distinct repeat units. Repeat units can be arranged in a variety of manners. For example, a homopolymer refers to a polymer with one type of repeat unit where the repeat units are adjacently connected. In another example, a plurality of different repeat units can be assembled as a copolymer. If A represents one repeat unit and B represents another repeat unit, copolymers can be represented as blocks of joined units (e.g., A-A-A-A-A-A . . . B-B-B-B-B-B . . . ) or interstitially spaced units (e.g., A-B-A-B-A-B . . . or A-A-B-A-A-B-A-A-B . . . ), or randomly arranged units. Of course, these representations can be made with 3 or more types of repeat units as well. In general, polymers (e.g., homopolymers or copolymers) include macromolecules in a broad range of configurations (e.g., cross-linked, linear, and/or branched).

The term "segments," and the phrase "polymer segments," which can be used interchangeably, refer to a portion of a polymer that includes one or more units. A segment can include one or more types of units (e.g., A-A-A-A or A-B-C-A-C).

Some embodiments are directed to compositions and methods for producing materials such as paper-based materials. Such embodiments can utilize an amine-containing polymer, which can be a polycation. The amine-containing polymer can associate with one or more components of a mixture (e.g., a paper-making mixture). Components can include pulp fibers, the surfaces of a particle filler, and other elements or portions of the elements. In general, the association of the amine-containing polymer with any particular component can functionalize that component, potentially increasing the strength, or improving one or more other qualities, of a paper product produced with compositions consistent with such embodiments.

Accordingly, some exemplary embodiments are directed to mixtures that can be used to produce various materials, such as paper-based materials. Though such mixtures can include any number of typical components utilized in commercial paper making, some embodiments include a solution medium (e.g., an aqueous solution), a pulp material, and filler particles. The mixtures can include an amine-containing polymer, which can associate and/or interact with one or more components of the mixture. For example, the amine-containing polymer can functionalize the component of the mixture with which the polymer interacts. In one aspect, the amine-containing polymer can functionalize the particle filler component (e.g., the surface of the filler particles), but does not substantially functionalize the pulp. In another aspect, the amine-containing polymer can functionalize the pulp (e.g., the fibers of the pulp), but does not substantially functionalize the filler component. In still another aspect, the amine-containing polymer functionalizes both the filler component and the pulp. Functionalization can and cannot also optionally occur with other components in a selective manner.

Functionalization of one or more components of a paper-making mixture with an amine-containing polymer can result in the enhancement of one or more properties of the mixture or a paper product formed from the mixture, relative to the properties when functionalization of the component is absent. For instance, functionalization of one or more components can lead to an enhancement of mechanical properties of a paper product, e.g., tensile strength.

With respect to the pulp and the filler particles in a mixture, though some embodiments can utilize functionalization of both components, some particular embodiments only functionalize one of the two components, while leaving the other component substantially unfunctionalized, i.e., either the pulp or the filler particles are functionalized, not both. It has surprisingly been found that in some instances, only functionalizing the pulp or the filler particles, but not both components, can lead to paper products that are stronger, or about as strong, relative to both components being functionalized.

The following text describes some features of the components of mixtures consistent with embodiments of the present invention. Unless specifically delineated in particular embodiments, it is understood that one or more of the described features, or specific components, can be utilized with any of the embodiments within the scope of the present application. For instance, any of the specific types of amine-containing polymers can be used in any mixture type (e.g. chitosan or polyalkyleneimines or a combination of the two can be used to functionalize any one or more of pulp, filler particles, and other components of a mixture). It is also understood that features of components can be utilized any combination with the embodiments consistent herein. For instance, in describing the average molecular weight of an amine-containing polymer, it is understood that such average molecular weights can be applied to any described polymer (e.g., homopolymers or copolymers of any particular type of polymer such as branched polyethyleneimine or polyvinylamine). It is further understood that those skilled in the art will appreciate variations and combinations of the described features that are also within the scope of the present disclosure.

With respect to various embodiments disclosed herein, an amine-containing polymer can be any homopolymer or copolymer that has at least a portion of its repeat units containing an amine (e.g., quaternary, ternary, secondary or primary). Advantageously, the amine-containing polymer can contain repeat units with primary amines due to the reactivity of the primary amine. In particular embodiments, the amine-containing polymer is a polycation. Polycations can be advantageously utilized, for example, when the components sought to be functionalized have a net negative charge. In such instances, the use of electrostatic interactions with pulp fibers and/or filler can be effective in certain embodiments when the pulp fibers and/or filler have an inherent negative charge that can interact with the polycation.

A variety of amine-containing polymers can be utilized with various embodiments that include one or more different types of amine-containing polymers. Amine-containing polymers can be naturally occurring macromolecules with amine groups such as chitosan. Also, various types of synthetic polymers bearing amine groups such as polyalkyleneimines, polyvinylamine, polyallylamine, and polydiallylamine can be utilized. Of course, copolymers comprising any combination of amine-containing homopolymer units can also be used.

In some instances, it can be advantageous to utilize amine-containing polymers that are relatively inexpensive because of the scale and relative costs of paper manufacturing. Chitosan is an aminopolysaccharide typically prepared by deacetylation of chitin (poly-beta(1,4)-N-acetyl-D-glucosamine) obtained from marine organisms such as shrimp, crabs, lobsters, squid, and the like. Accordingly, it can be prepared with relative ease. Branched polyethyleneimine (herein "BPEI") is an easily manufactured synthetic polymer that is also readily available at moderate cost. Thus, some embodiments utilize chitosan, polyethyleneimine (such as BPEI), or a combination of the two polymers as separate homopolymers or as one or more copolymers. Though many specific instances herein discuss the use of chitosan with particular embodiments and examples, it is understood that such descriptions are merely demonstrative of features of the present invention, and not intended to limit the practice of the present invention.

Though the average molecular weight of an amine-containing polymer is not necessarily limited, in some embodiments the average molecular weight of the amine-containing polymer can range from about 1,000 daltons to about 10,000,000 daltons; or from about 10,000 daltons to about 500,000 daltons. Such ranges can advantageously utilize amine-containing polymers which can be large enough to functionalize one or more components effectively, while not being so large as to effect the paper-making process.

Measurement of the average molecular weights for any polymer discussed herein can be with respect to a number of bases. For example, can be number averaged, weight averaged, or averaged based on some other weighting factors. As well, the techniques utilized to determine molecular weight can include the range of those known to those skilled in the art. Examples include gel permeation chromatography and light-scattering.

For certain amine-containing polymers, the average molecular weight can be difficult to ascertain. Chitosan is an example of such an amine-containing polymer. In such instances, the average molecular weight of the polymer can be defined by some alternative parameter such as viscosity. Accordingly, in some embodiments the chitosan has an average molecular weight defined by a viscosity range between about 10 centipoise and about 800 centipoise. The viscosity can optionally be further defined by a set of conditions, such as being measured for a 1% solution of chitosan in pH 4 (or 0.1M) aqueous acetic acid at 25° C.

The pulp utilized in some embodiments disclosed herein can comprise fibers such as cellulose-based fibers, and can also include components typically found in pulps used to make paper products. Accordingly, the fibers of the pulp can have a net negative charge. Such charge can be utilized advantageously in some embodiments to cause electrostatic attraction of an amine-containing polymer that is, or is partially, a polycation. In some embodiments, the fibers of a pulp exclude the presence of synthetic fibers such as polymer-based fibers (e.g., aromatic amide fibers). Thus, some embodiments utilize pulps that include substantially naturally-occurring fibers.

Fillers utilized in some embodiments disclosed here can include particulates that are typically utilized as fillers in paper manufacturing applications. For instance, the fillers can have a surface that is, at least partially, substantially inorganic in nature. Thus, non-limiting examples of filler particles can include particles constructed from calcium, carbonate, kaolin, titanium dioxide, and other inorganic materials. Fillers can also be a composite of inorganics. In some embodiments, the surface of the fillers can have a net negative charge, which can tend to attract amine-containing polymers that are polycationic in nature.

In some embodiments, functionalization of one or more components (e.g., pulp and/or filler) can be achieved by some type of coupling interaction between an amine-containing polymer and the component. Such coupling can be achieved using either through a coupling agent or through electrostatic interactions that permit the polyamine to self-assemble onto the surface of the component. The use of electrostatic interactions with pulp fibers and filler can be effective in certain embodiments because both pulp fibers and filler have an inherent negative charge that can interact with the polyamine. Coupling agents, such as multifunctional crosslinking agents described herein, can be used to increase the amount of amine-containing polymer that can adhere to a surface, such as a surface of the filler particles.

For the compositions and methods disclosed herein, multifunctional crosslinking agents can be used as a coupling agent. Such agents can react with at least one of the amine-containing polymer and the component to be coupled. For example, in some embodiments the multifunctional coupling agent can include a silicon containing coupling agent and at least one of the following functional groups: an epoxy group, a hydroxyl group, a carboxyl group, and/or an isocyano group. In one embodiment, the multifunctional coupling agent is a silane coupling agent. In another embodiment, the coupling agent does not include silicon (e.g., in embodiments in which silicon is not used). In certain embodiments, the multifunctional coupling agent includes an isocyanosilane, for example, a trialkoxy isocyanosilane such as trimethoxy isocyanosilane, triethoxy isocyanosilane, and/or triisopropoxy isocyanosilane. In certain embodiments, the multifunctional coupling agent includes an epoxy siloxane. The multifunctional coupling agent can include triethoxy methacryloxypropyl silane. Other agents can also be employed as would be understood by those of skilled in the art.

In some embodiments, functionalization of a paper making component can be achieved without the use of a coupling agent. For instance, the amine-containing polymer can be added directly to a pulp stream, a filler stream, or to both, resulting in the association of the amine-containing polymer and the pulp, filler, or both. If chitosan is used as the amine-containing polymer, the component can be functionalized by precipitating chitosan onto the surface of the component using, for example, a shift in pH. Since chitosan is only soluble in acidic conditions, the polymer can be made to precipitate when the pH is raised by adding a base to the solution after adding chitosan (e.g., to a pH of at least about 6). Accordingly, it can be advantageous to prepare mixtures of one or more components (e.g., one or more of fillers and pulp) with chitosan having a pH close to the precipitation point of the amine-containing polymer to reduce the amount of base needed to induce precipitation and functionalize the component. Thus, the pH of the mixture can be in the range from about 4 to about 8; or from about 5 to about 8; or from about 6 to about 8. In some instances, it can be advantageous to utilize a multivalent acid to enhance the dissolution of chitosan into a pulp furnish or other paper-making mixture. Accordingly, some embodiments can utilize a mixture with one or more multivalent acids; non-limiting examples include citric, tartaric, aldaric (any in the family), oxalic, malonic, malic, succinic, glutaric, and adipic acid.

Alternatively, precipitation can occur spontaneously when a chitosan solution is added to a basic environment like a calcium carbonate solution. In some embodiments, the amount of chitosan to be added can be from about 0.01% to about 5.0% (based on weight of the component), or from about 0.1% to about 2%.

In some embodiments, a complementary polymer can be added to a paper-making mixture. In general, the complementary polymer can be capable of coupling with an amine-containing polymer (e.g., the complementary polymer can react or nonreactively interact with the amine-containing polymer). Such a complementary polymer can be used to enhance the properties of the mixture, or a resulting paper product produced from the mixture, relative to not using the complementary polymer. The complementary polymer can be utilized when an amine-containing polymer is intended to functionalize pulp (e.g., fibers), filler particles, or both pulp and filler particles, among other paper-making mixture components.

In a mixture, the complementary polymer can be coupled with the amine-containing polymer, or can be free but will eventually couple with the amine-containing polymer. As well, the complementary polymer can be added to a process after an amine-containing polymer has functionalized one or more mixture components, or before functionalization has occurred such as in an emulsion technique described herein.

Some embodiments can utilize any complementary polymer (e.g., homopolymers, copolymers, and combinations of different polymers) which can interact nonreactively with an amine-containing polymer or which can react with the amine-containing polymer (e.g., reacting with an amine group). If the complementary polymer nonreactively interacts rather than reacts with the amine-containing polymer, the interaction may involve electrostatic forces, hydrogen bonds, or any other secondary interaction forces or association mechanisms. For example, the nonreactive interaction can be an electrostatic interaction when a polyanion is used as a portion or the entirety of the complementary polymer. Accordingly, an appropriate polymer can also be used that includes repeat units with anionic charge. Advantageously, the polyanion can include one or more carboxylic acid groups. Non-limiting examples of suitable polyanions, or polyanion segments, include biopolymers such as pectin, xanthum gum, and carboxymethyl cellulose, and synthetic polymers such as polyacrylic acid or polymethacrylic acid. Other types of complementary polymers, such as polyanions or polymers with polyanionic segments, can also be used consistent with the embodiments disclosed herein.

In embodiments when the complementary polymer can react with the amine-containing polymer, the complementary polymer can contain repeat units that include one or more groups which can react with a portion of the amine containingpolymer. In particular embodiments, the groups can be selected to react with an amine functionality (primary, secondary, ternary, or quaternary). Such groups include but are not limited to epoxides, anhydrides (e.g., maleic anhydride), carboxylic acids, and isocyanates. When copolymers are utilized as a complementary polymer, such copolymers can also contain some repeat units with these reactive groups. The molecular weight of the complementary polymer can be between about 1,000 daltons and about 10,000,000 daltons; or between about 10,000 daltons and about 500,000 daltons.

As previously mentioned, a complementary polymer can be used to enhance the properties of a mixture, or a resulting paper product produced from the mixture. For example, the complementary polymer can be used to provide additional strength to a resulting paper-based product, whether an amine-containing polymer is used to functionalize pulp, filler particles, or both pulp and filler. Without being bound by theory, it is believed that the complementary polymer can act to bridge components that have been functionalized with the amine-containing polymer. As an example, if only the pulp fibers are functionalized, the polymer bridges different fibers. However, if both the pulp and filler have been functionalized, the filler can also be bound to the pulp for enhancing mechanical properties of the paper making mixture or a resulting paper product.

In some embodiments, the complementary polymer can contain one or more components that can impart additional or alternative properties to a resulting paper product besides strength enhancement. As an example, elastic homopolymers or copolymers can be used to change the resulting paper's stiffness or wear resistance, or hydrophobic homopolymers or copolymers can be used to change the water contact angle (e.g., the tendency to resist water penetration). Combinations of various types of complementary polymers can also be used to provide multiple property enhancement (e.g., strength, elasticity, and water resistance).

In other embodiments, the complementary polymer can be emulsified by the amine-containing polymer. This combination can be mixed with a portion of a pulp furnish, i.e., delivered in one addition versus in sequential steps. In this case, one or a combination of the type of amine-containing polymers discussed previously can be used, along with one or more complementary polymers which are not soluble in water. The complementary polymer can interact nonreactively or react with the amine-containing polymer. Besides being substantially hydrophobic, the complementary polymer can have any of the properties previously disclosed herein. The complementary polymer can either be emulsified using the amine-containing polymer alone (e.g., if it is in liquid form) or dissolved in a water immiscible solvent to form a "water-in-oil" emulsion. This emulsion can then be added to either the fiber and/or filler stream so that the amine-containing polymer can interact with the filler and/or fiber. For example, upon drying, the miscelle can open up to allow the emulsified polymer to interact or bind between multiple fillers and/or fibers.

Some exemplary embodiments are drawn to methods of producing materials such as paper-based materials, which are optionally consistent with one or more of the compositions disclosed herein. One exemplary method includes functionalizing fibers of a pulp using an amine-containing polymer. Filler particles can be combined with the functionalized pulp fibers to produce at least a portion of a paper-forming mixture such as a pulp furnish. A paper-based material can then be produced from the paper-forming mixture. In some instances, it can be advantageous for the method not to substantially functionalize the filler particles, though the pulp components can be functionalized. The method can be practiced as a batch process or in continuous fashion using flowing streams of components.

In alternative embodiments, the methods of producing materials functionalize filler particles (e.g., the surface of filler particles) using the amine-containing polymer. Fibers of a pulp can be combined with the functionalized filler particles to produce a portion or the entirety of a paper-making mixture, which can be subsequently used to produce a paper-based material. In this embodiment, it can be advantageous in some instances to not substantially functionalize the fibers of the pulp. In still other embodiments, both the pulp and the filler particles can be functionalized.

The types of amine-containing polymers, filler particles, and pulps that can be used with these methods include all the types disclosed in the present application. As well, specific techniques for functionalizing the pulp, filler particle, or both pulp and filler particles can follow the techniques disclosed herein (e.g., addition of coupling agents to aid coupling of an amine-containing polymer to a component). In one particular example, chitosan can be combined with either pulp or filler particles to form a functionalizing mixture. The pH of the mixture can be raised to a level of at least about 6 to cause the chitosan to associate with the pulp fibers or filler particles, thereby functionalizing the component. It is also understood that paper-forming mixtures utilized in the various methods can include any of the other components of mixtures disclosed herein (e.g., complementary polymers).

The step of producing a paper-based material from the paper-forming mixture can utilize any set of paper forming techniques including those known to ones skilled in the art. For example, the paper-forming mixture can be set on a screen to form a sheet. The sheet can be subsequently dried to form the paper product. Modifications of this technique and others to accommodate embodiments disclosed herein are also contemplated by the present application.

For example, in methods that utilize a complementary polymer, the complementary polymer can be added to a paper-making mixture before a sheet is formed from the mixture, or after the sheet has been formed (e.g., applied onto the sheet). When the complementary polymer is added to the process before sheet formation, it can be of sufficient quantity to produce a desired enhancement in some property (e.g., mechanical properties of the end paper product), but not enough to cause problems with sheet formation. In some embodiments, this addition level can be from about 0.01% to about 5.0% (based on sheet dry weight), or between about 0.1% and about 2%.

When the complementary polymer is added after sheet formation, it can be added prior to drying the sheet (e.g., while the sheet is still on the paper machine), or it may be added after drying the sheet (e.g., in a coating or other dry end process). The polymer can be added in solution form which can either be aqueous or non-aqueous. Aqueous solutions can be used when addition is done prior to drying the sheet, but non-aqueous solutions can be advantageous after drying due to energy usage in eliminating the solvent. When the complementary polymer is reactive, the reaction can occur anytime in the process after introduction of the complementary polymer, i.e., the reaction between the complementary polymer and the amine-containing polymer can occur either immediately after addition or anytime thereafter.

In alternative embodiments connected with the use of a complementary polymer, the methods described herein can include emulsifying a complementary polymer (e.g., a substantially hydrophobic polymer) with the amine-containing polymer in an aqueous solution. The emulsion formed from the complementary polymer and amine-containing polymer can be added to the pulp fibers, the filler particles, or both to cause the amine-containing polymer to functionalize one or more components. In instances where both pulp fibers and filler particles are functionalized, the amine-containing polymer can couple a portion of the pulp and a portion of the filler particles.

Other embodiments are drawn to paper-based materials that can be produced from any of the mixtures or methods described in the present application.

EXAMPLES

The following examples are provided to illustrate some aspects of the present application. The examples, however are not meant to limit the practice of any embodiment of the invention.

Example 1

Control Pulp Synthesis

A 5% pulp slurry was prepared by blending 17.5 g of pine furnish (dry weight) with 32.5 g of birch (dry weight) in 1 L of water. This thick slurry was then diluted to 0.5% by adding 9.5 L of water to the 1 L of thick stock slurry.

Example 2

Chitosan on Pulp (No Base Addition)

A 5% pulp slurry was prepared by blending 17.5 g of pine furnish (dry weight) with 32.5 g of birch (dry weight) in 1 L of water. This thick slurry was then diluted to 0.5% by adding 9.5 L of water to the 1 L of thick stock slurry. To this 0.5% slurry, 12.5 mL of a 2.0% CG110 chitosan solution (Primex, Iceland) was slowly added.

Example 3

Chitosan on Pulp (With Addition of NaOH)

A 5% pulp slurry was prepared by blending 17.5 g of pine furnish (dry weight) with 32.5 g of birch (dry weight) in 1 L of water. This thick slurry was then diluted to 0.5% by adding 9.5 L of water to the 1 L of thick stock slurry. To this 0.5% slurry, 12.5 mL of a 2.0% CG110 chitosan solution was slowly added. A solution of 0.1 M NaOH was then titrated into the pulp slurry until the pH reached 8.0 (the original pH was approximately 6.5—example 2).

Example 4

Control Precipitated Calcium Carbonate (PCC)

A 10% PCC slurry was made by stirring 100 g of PCC into 1 L of water.

Example 5

Chitosan Coated PCC

A 10% PCC slurry was made by stirring 10 g of PCC into 100 mL of water. To this slurry, 2.5 mL of a 2.0% CG110 chitosan solution was slowly added. The high pH of the PCC solution caused the chitosan to precipitate onto the PCC particles. This was verified by taking a sample and attaching a reactive intense blue dye that turned the PCC blue. The dye did not react with PCC that was not functionalized with chitosan.

Example 6

Handsheet Preparation

Handsheets were prepared using a handsheet maker, model Mark V Dynamic Handsheet Mold/Paper Chemistry Jar from Paper Chemistry Laboratory Inc. (Larchmont, N.Y.). The appropriate volume of 0.5% pulp slurry (functionalized or unfunctionalized) was combined with the appropriate volume of the 10% filler slurry (functionalized or unfunctionalized). This combined slurry was diluted with water up to 2 L and added to the handsheet maker. The overhead stirrer was then powered on and set to stir at 1100 RPM for 5 seconds, 700 RPM for 5 seconds, 400 RPM for 5 seconds, and then raised out of the slurry. The water was then drained off. The subsequent sheet was then transferred off of the wire and pressed and dried. Each test condition was repeated to make two handsheets for each trial point. Three 1" wide strips were then cut out from each handsheet for tensile testing on an Instron Single Column Testing System Model #3343 (Norwood, Mass.). The reported values are the averages of the six strips (three from each handsheet).

Example 7

Control 100% Pulp

Two handsheets were produced using the above procedure. In the process, 500 mL of pulp from example 1 was used along with no filler. These were control sheets that had an average max load/width of 9.9 lb/in. When normalized by the basis weight (i.e., the density of each sheet on a mass per unit area basis), the result was 0.11 lb*m$^2$/in/g.

Example 8

100% Pulp (W/Chitosan, No Base)

Two handsheets were produced using the above procedure. In the process, 500 mL of pulp from example 2 was used with no filler. These sheets that had an average max load/width of 10.1 lb/in. When normalized by the basis weight, the result was 0.12 lb*m$^2$/in/g.

Example 9

Control 90% Pulp/10% PCC

Two handsheets were produced using the above procedure. In the process, 450 mL of pulp from example 1 was used along with 12.5 mL of filler from example 4. The retention of the filler from example 4 with pulp from example 1 was previously tested to be approximately 20%, so these handsheets would be approximately 10% by weight PCC. These 90% fiber/10% PCC sheets had an average max load/width of 5.9 lb/in. When normalized by the basis weight, the result was 0.068 lb*m$^2$/in/g.

Example 10

90% Pulp (With Chitosan, No Base)/10% PCC

Two handsheets were produced using the above procedure. In the process, 450 mL of pulp from example 2 was used along with 3.0 mL of filler from example 4. The retention of the filler from example 4 with pulp from example 2 was previously tested to be approximately 83%, so these handsheets would be approximately 10% by weight PCC. These 90% fiber/10% PCC sheets had an average max load/width of 9.1 lb/in. When normalized by the basis weight, the result was 0.095 lb*m$^2$/in/g.

Example 11

90% Pulp (With Chitosan, NaOH Added)/10% PCC

Two handsheets were produced using the above procedure. In the process, 450 mL of pulp from example 3 was used along with 3.0 mL of filler from example 4. The retention of the filler from example 4 with pulp from example 3 was previously tested to be approximately 83%, so these handsheets would be approximately 10% by weight PCC. These 90% fiber/10% PCC sheets had an average max load/width of 10.1 lb/in. When normalized by the basis weight, the result was 0.11 lb*m$^2$/in/g; a substantially similar result to the control sample of 100% pulp.

Example 12

90% Pulp/10% PCC (With Chitosan)

Two handsheets were produced using the above procedure. In the process, 450 mL of pulp from example 1 was used along with 2.5 mL of filler from example 5. The retention of the filler from example 5 with pulp from example 1 was previously tested to be approximately 99%, so these handsheets would be approximately 10% by weight PCC. These 90% fiber/10% PCC sheets had an average max load/width of 8.2 lb/in. When normalized by the basis weight, the result was 0.087 lb*m$^2$/in/g.

Example 13

90% Pulp (With Chitosan, NaOH Added)/10% PCC (With Chitosan)

Two handsheets were produced using the above procedure. In the process, 450 mL of pulp from example 3 was used along with 2.5 mL of filler from example 5. The retention of the filler from example 5 with pulp from example 1 was previously tested to be approximately 99%, so these handsheets would be approximately 10% by weight PCC. These 90% fiber/10% PCC sheets had an average max load/width of 7.2 lb/in. When normalized by the basis weight, the result was 0.080 lb*$m^2$/in/g. Accordingly, example 13 shows that functionalizing the pulp and PCC with chitosan unexpectedly results in a sheet that is less strong than just functionalizing the pulp (example 11) or just functionalizing the PCC (example 12).

Example 14

Addition of a Complementary Polymer

Handsheets were created using the above procedures. After drying the handsheet, approximately 6.5 mL of a 0.2% aqueous poly[(isobutylene-alt-maleic acid), ammonium salt)-co-(isobutylene-alt-maleic anhydride] solution was applied to the handsheet. Each test condition was repeated to make two handsheets for each trial point. Three 1" wide strips were then cut out of each handsheet for tensile testing on the Instron 3343. The reported values are the averages of the six strips (three from each handsheet).

Example 14a

Poly[(isobutylene-alt-maleic acid), ammonium salt)-co-(isobutylene-alt-maleic anhydride] Added to 100% Pulp Two handsheets were made using the procedure described in example 7 (100% pulp). Then, the sheets were treated with the Poly[(isobutylene-alt-maleic acid), ammonium salt)-co-(isobutylene-alt-maleic anhydride] solution using the above procedure. These sheets had an average max load/width of 13.2 lb/in. When normalized by the basis weight, the result was 0.14 lb*$m^2$/in/g.

Example 14b

Poly[(isobutylene-alt-maleic acid), ammonium salt)-co-(isobutylene-alt-maleic anhydride] Added to 100% Pulp with Chitosan Two handsheets were made using the procedure described in example 8 (100% pulp with chitosan). Then, the sheets were treated with the Poly[(isobutylene-alt-maleic acid), ammonium salt)-co-(isobutylene-alt-maleic anhydride] solution using the above procedure. These sheets had an average max load/width of 14.2 lb/in. When normalized by the basis weight, the result was 0.16 lb*$m^2$/in/g.

In example 14a, the second polymer addition produced a sheet approximately 35% stronger than the control sheet (example 7). In example 14b, a sheet was produced that was approximately 50% stronger than the sheet with chitosan on pulp (example 8).

While the present invention has been described in terms of specific methods, structures, and devices it is understood that variations and modifications will occur to those skilled in the art upon consideration of the present application. As well, the features illustrated or described in connection with one embodiment may be combined with the features of other embodiments. Such modifications and variations are intended to be included within the scope of the present invention. Those skilled in the art will appreciate, or be able to ascertain using no more than routine experimentation, further features and advantages of the invention based on the above-described embodiments. Accordingly, the invention is not to be limited by what has been particularly shown and described, except as indicated by the appended claims. All publications and references are herein expressly incorporated by reference in their entirety.

What is claimed is:

1. A mixture for producing a paper-based material, comprising:

an aqueous medium;

pulp comprising fibers having a negative charge;

filler particles having an inorganic surface; and a cationic amine-containing polymer for enhancing properties of at least one of the mixture and the paper-based material, the cationic amine-containing polymer being substantially functionalized to only one of the pulp and the filler particles, wherein the cationic amine-containing polymer is chitosan and wherein said chitosan is substantially functionalized by precipitation to only one of the pulp and the filler particles.

2. The mixture of claim 1, wherein the pulp is substantially free of synthetic polymer-based fibers.

3. The mixture of claim 1, further comprising:

a complementary polymer for enhancing the properties of at least one of the mixture and the paper-based material, the complementary polymer capable of coupling with the amine-containing polymer, the coupling comprising at least one of reacting and interacting non-reactively with the amine-containing polymer.

4. The mixture of claim 3, wherein the complementary polymer is polyanionic.

5. The mixture of claim 4, wherein the complementary polymer includes carboxylic acid groups.

6. The mixture of claim 5, wherein the complementary polymer includes at least one segment comprising at least one of pectin, xanthan gum, carboxymethyl cellulose, polyacrylic acid, and polymethacrylic acid.

7. The mixture of claim 3, wherein the complementary polymer comprises at least one group from epoxides, anhydrides, carboxylic acids, and isocyanates.

8. The mixture of claim 3, wherein the complementary polymer includes a component that increases water resistance of the paper-based material.

9. The mixture of claim 3, wherein the amine-containing polymer emulsifies the complementary polymer.

10. A paper-based material, comprising:

pulp comprising fibers having a negative charge;

filler particles having an inorganic surface; and a cationic amine-containing polymer for enhancing properties of the paper-based material, the cationic amine-containing polymer being substantially functionalized to only one of the pulp and the filler particles, wherein the cationic amine-containing polymer is chitosan and wherein said chitosan is substantially functionalized by precipitation to only one of the pulp and the filler particles.

11. The mixture of claim 1, wherein the cationic amine-containing polymer is substantially functionalized to the pulp.

12. The mixture of claim 1, wherein the cationic amine-containing polymer is substantially functionalized to the filler particles.

* * * * *